United States Patent [19]

Williams

[11] 4,252,496

[45] Feb. 24, 1981

[54] HYDRAULIC CLAMP FOR TRAYS OF CANNED BEVERAGES

[76] Inventor: John A. Williams, 8453 S. Rhodes St., Chicago, Ill. 60619

[21] Appl. No.: 736,911

[22] Filed: Oct. 29, 1976

[51] Int. Cl.[3] ..... B66F 9/18

[52] U.S. Cl. ..... 414/623; 294/87 R; 294/113; 414/607

[58] Field of Search ..... 214/620, 655; 294/87 R, 294/88, 106, 113

[56] References Cited

U.S. PATENT DOCUMENTS

| | | | |
|---|---|---|---|
| 3,020,078 | 2/1962 | Ray | 294/113 |
| 3,237,980 | 3/1966 | Helms | 294/113 |
| 3,339,966 | 9/1967 | Carlson | 294/106 |
| 3,637,250 | 1/1972 | Blonsky | 294/106 |
| 3,718,228 | 2/1973 | Lund et al. | 214/620 |
| 3,854,616 | 12/1974 | Willis et al. | 214/620 |
| 3,971,485 | 7/1976 | Hoppey | 214/620 |
| 3,984,020 | 10/1976 | Fuller et al. | 214/620 |
| 4,005,895 | 2/1977 | Cullings | 294/106 |

*Primary Examiner*—Randolph A. Reese
*Assistant Examiner*—Ross Weaver
*Attorney, Agent, or Firm*—Lockwood, Dewey, Alex & Cummings

[57] ABSTRACT

A grapple clamp for lifting a group of objects such as a plurality of cases of soft drinks. The clamp has four clamp jaws hinged to a frame in rectangular or square orientation so as to engage a group of objects with equal force from four sides. The clamp is adapted to be carried by a fork lift truck and each pair of opposing jaw clamps is actuated by a hydraulic or pneumatic cylinder. Preferably, hydraulic cylinders are used which are powered by the hydraulic system of the lift truck. The cylinders are interconnected so that the clamping forces exerted by the two pairs of clamp jaws are equalized.

6 Claims, 7 Drawing Figures

FIG. 3
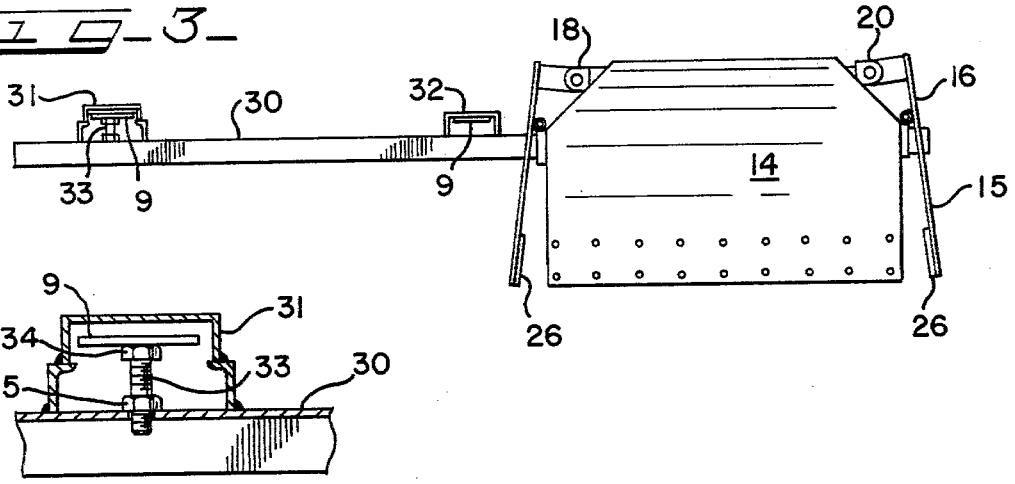
FIG. 7
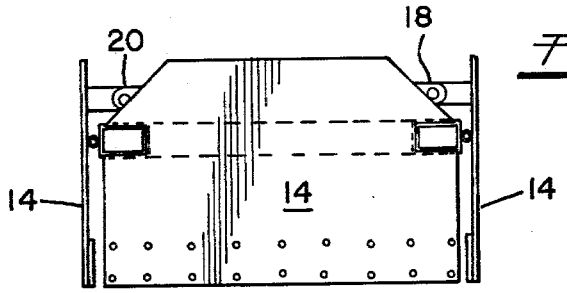
FIG. 5
FIG. 6
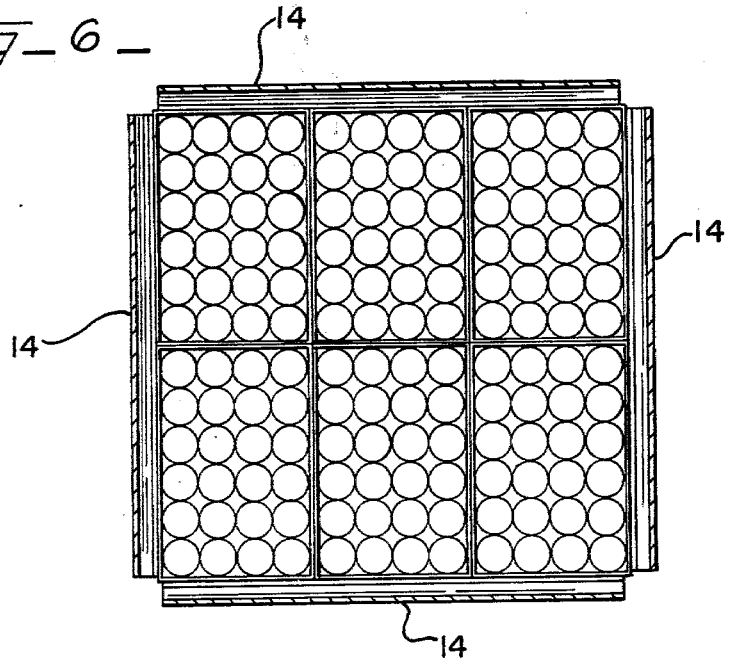

HYDRAULIC CLAMP FOR TRAYS OF CANNED BEVERAGES

This invention relates generally to a clamp means for lifting a group of objects such, for example, as twelve cases or cartons of soft drinks, beer or other bottled products. More specifically, the invention relates to a grapple clamp of the foregoing type which is adapted to be readily mounted on, and removed from, the forks of a fork lift truck and used in a bottling plant for loading a soft drink delivery truck.

The object of the invention, generally stated, is the provision of a grapple clamp for lifting a group of objects such, for example, as a plurality of cases of soft drinks, which is readily mounted on the forks of a lift truck and has hydraulic or pneumatic actuating cylinders readily connected with a source of pressurized hydraulic fluid or air carried by the lift truck and adapted to be controlled by a control valve means on the lift truck.

While the present invention has a number of uses and may be made in a number of different embodiments, it will be described specifically in connection with an embodiment particularly suited for use with a fork lift truck for clamping together as a group for lifting a plurality of cases or trays of soft drinks and for depositing the same on a delivery truck or the like.

For a more complete understanding of the nature and scope of the invention reference may now be had to the following detailed description of an exemplary embodiment thereof taken in connection with the accompanying drawings, wherein:

FIG. 1 is a perspective view showing a grapple clamp forming an embodiment of this invention mounted on the front end of a fork lift truck and positioned over a group of cases of soft drinks or the like;

FIG. 3 is a side elevational view of the clamp shown in FIG. 1 looking toward the front of the lift truck;

FIG. 5 is an elevational view taken on line 5-5 of FIG. 2;

FIG. 6 is a sectional view taken on line 6-6 of FIG. 1; and

FIG. 7 is a detail sectional view taken on line 7-7 of FIG. 2.

Figure 1:
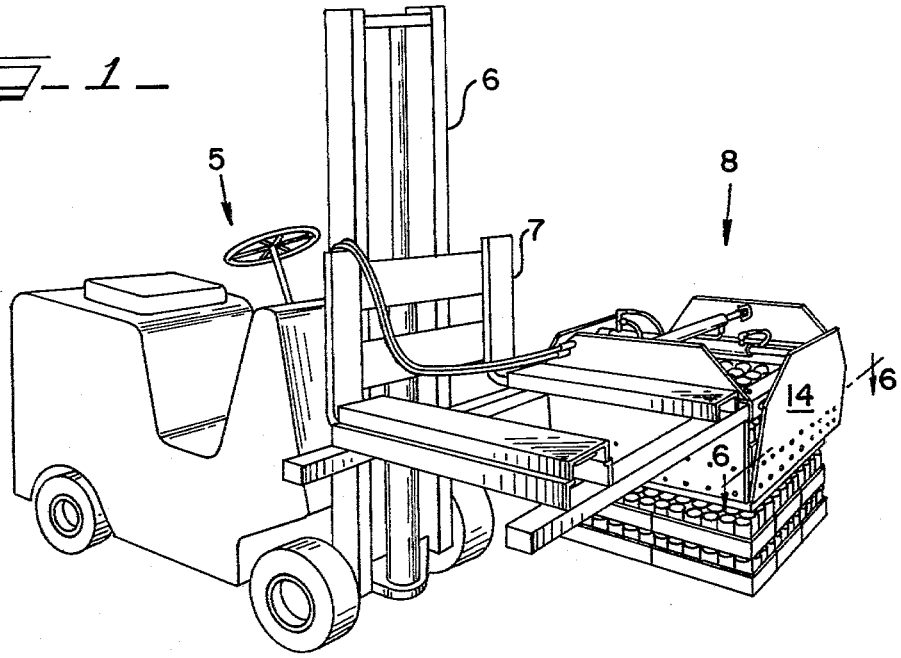

In FIG. 1 a lift truck of conventional design and known commercial type is indicated generally at 5 having a fixed vertical mast 6 and vertically reciprocable fork lift attachment 7 mounted thereon with a pair of fork members 9-9 (FIGS. 3 and 4) projecting forwardly therefrom in horizontal parallel relationship. A grapple clamp made in accordance with the present invention and indicated generally at 8 is mounted on the forks 9 by suitable mounting means to be described in detail.

Figure 2:
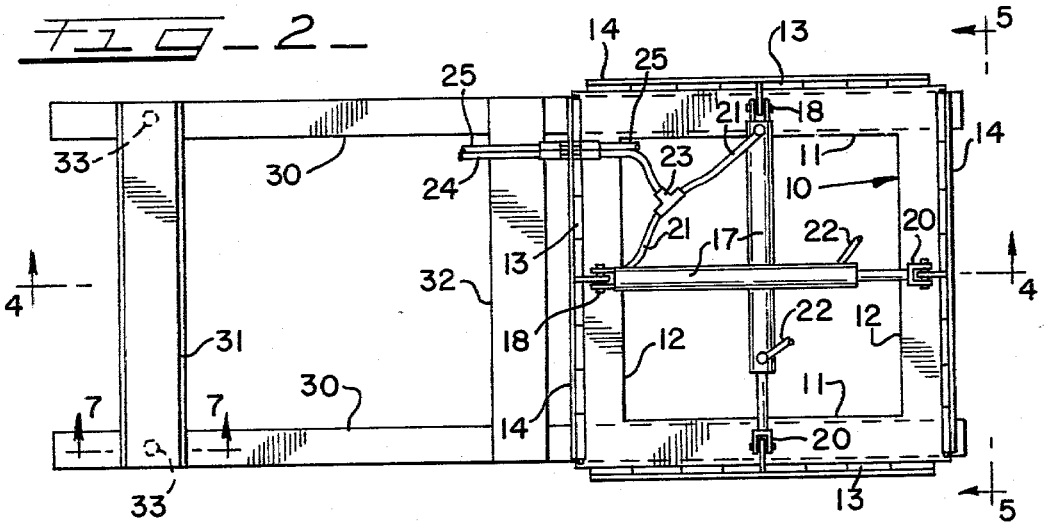
FIG. 2 is a top plan view of the grapple clamp shown in FIG. 1.
Figure 4:
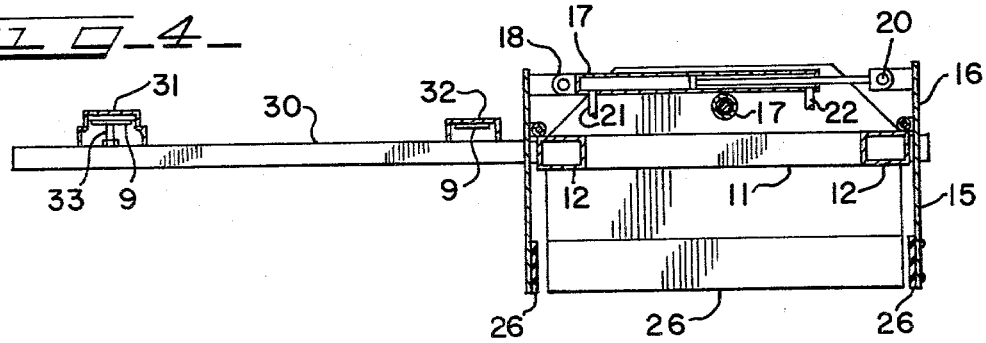
FIG. 4 is a vertical sectional view taken on line 4-4 of FIG. 2.

The clamp 8 includes a square frame indicated generally at 10 in FIG. 2 and comprising two opposed side members 11—11 which are hollow and rectangular in cross section and two opposed interconnecting side members 12—12 which may also be hollow and of rectangular cross section. Piano hinges 13—13 are mounted adjacent the upper outer corners of opposing sides 12—12 of the frame 10 (FIG. 4). A second pair of piano hinges 13—13 is mounted on the outer vertical walls of opposing sides 11—11 of frame 10 somewhat below the upper outer corners (FIG. 5). The free or swingable part of each hinge 13 has mounted thereon a clamp jaw 14. Each of the clamp jaws 14 has a rectangular lower portion 15 depending below its supporting hinge 13 and an upwardly projecting actuating portion 16. The upper corners of the actuating portions 16 are removed so that these portions may be swung inwardly without interference.

The upwardly projecting actuating portions 16 of one pair of opposing clamp jaws 14 are interconnected adjacent but below their top edges and midway between opposite ends by a double-acting hydraulic cylinder 17 (FIG. 5). The remaining pair of opposing clamp jaws 14 are interconnected at their top edges by a second double-acting cylinder 17 located above the other cylinder 17 (FIG. 4). The arrangement is such that the moment or leverage arms of each jaw 14 are the same so that the clamp force exerted by each jaw is the same.

It will be apparent that when the cylinders 17 are extended, the interconnected actuating portions 16-16 will be moved away from each other thereby swinging the lower depending clamping portions 15 inwardly toward each other. One end of each of the cylinders 17 is pivotally attached to an upwardly projecting actuating portion 16 by a pin and clevis attachment of known type indicated at 18. Similarly, the outer end of the piston rod of each of the cylinders 17 is pivotally connected to an upwardly projecting operating portion 16 by means of a pin and clevis connection 20.

Fluid inlet-outlet connections are provided in opposite ends of each of the cylinders 17 from which pressure hoses 21—21 and 22—22 extend. The hose connections 21—21 are connected to a T-fitting 23 the intermediate leg of which is connected with a pressure hose 24 which is in communication with an operating valve (not shown) which is interconnected in the hydraulic system of the lift truck 5 and mounted thereon for manipulation by the operator. The hose connections 22—22 extending from the piston rod end of each of the cylinders 17 are similarly connected to the intermediate leg of a T-fitting (not shown) which is similarly connected to a second pressure line 25 which also communicates with the operating valve on the lift truck 5. It will be seen that when hydraulic fluid under pressure is admitted through the line 24 and in turn through the connections 21 into the cylinders 17, the piston rods will be extended and hydraulic fluid within the cylinders 17 will be discharged through connections 22—22 and line 25 back to the sump or reservoir (not shown) of the hydraulic system on the lift truck 5. Conversely, when hydraulic pressure is admitted through the hose connections 22, the piston rods will be retracted forcing hydraulic fluid outwardly through the discharge connections 21 and line 24 to the sump or reservoir of the hydraulic system.

If desired, as a precautionary measure in the event hydraulic pressure is lost while the clamp 8 is lifting a load, known check valves may be included in the hydraulic system of the clamp. For example, a double pilot-operated check valve of known commercial type may be used to prevent each clamp jaw 14 and double-acting cylinder 17 from drifting during operation or from release on pressure failure.

Preferably, a horizontal strip of resilient or rubber-like clamping material 26-26 is secured to the inner face at the lower end of each of the clamp jaws 14 so as to provide for improved frictional engagement with objects to be lifted. The strips 26 also help prevent surface damage to the objects to be lifted.

It is important to be able to readily mounted the grapple clamp 8 on the lift truck 5. The arrangement shown comprises a pair of parallel beams 30—30 of rectangular cross section and such size as to be telescoped into the parallel side frame members 11—11. Downwardly facing channel members 31 and 32 are mounted as by welding on the tops of the members 30—30. The members 31–32 are parallel and spaced so as to receive therein the forks 9—9 of the fork lift truck 5. The channel member 31 is deeper than member 32 so as to accommodate a pair of leveling screws 33—33 (FIGS. 2 and 7). Referring to FIG. 7, it will be seen that the screws 33 extend through tapped holes in the top wall of the members 30 with their heads 34 engaging the underside of the fork 9 within member 31. Each screw 33 is provided with a jam nut 35 which serves to lock the leveling screw after its head 34 has been adjusted to the desired height in leveling the clamp 8. In this connection, it will be seen that weight of the clamp 8 tends to produce clockwise pivoting around the fork 9 that is in member 32. Engagement of the screw heads 34 on the underside fork 9 limits this pivoting.

The manner in which the grapple clamp 8 operates and is used to lift a group of objects will be described. As shown in FIGS. 1 and 6, a dozen cases or trays of soft drinks in cans are arranged in two square layers of six cases each. With the cylinders 17 retracted so that the lower depending portions 15 of the clamp jaws 14 are swung outwardly (as shown in FIG. 3) the lift truck is operated so as to lower the clamp downwardly over the stacked cases of soft drinks. After the clamp 8 has been lowered sufficiently so that the resilient strips 26 are opposite the lower edges of the bottom layer of stacked cases of soft drinks, the control valve (not shown) on the lift truck is operated so as to admit hydraulic fluid under pressure to the inlet connections 21—21 thereby extending the cylinders 17—17. This extension of the cylinders causes the lower portions of the clamp jaws 14 to swing inwardly toward each other and into clamping engagement with the lower sides of the lower tier of trays or cases of soft drinks. It will be seen that since the connections 21—21 are in communication with each other at the T-fitting 23, the clamping forces exerted by each opposing pair of clamp jaws 14 will be equalized on all four sides of the stack of cases to be lifted.

When the cases of soft drinks or other objects have been suitably clamped, the lift truck 5 can be operated in the normal manner to lift the clamp 8 bodily thereby lifting with it the 12 cases of soft drinks. After the same have been lifted, the lift truck 5 may be moved to a suitable location such as a delivery truck and the clamp 8 properly positioned so that when the cylinders 17 are retracted the twelve cases of soft drinks will be set down in the desired position.

It will be appreciated that a number of design changes can be made in the grapple clamp 8 as specifically shown and described. Thus, the size of the clamp may be changed and it may be made rectangular as distinguished from square. The double-acting cylinders may be replaced with one-way acting, spring-retracting, cylinders. The mounting members 30 may be replaced with parallel channels spaced to receive the forks 9 so that the clamps 8 may be mounted directly in front of the lift truck 5. These and other changes may be made without departing from the spirit and scope of the invention as defined in the appended claims.

I claim:

1. A grapple clamp for engaging a plurality of objects with sufficient equalized clamping force from four sides to permit lifting thereof, comprising, rectangular frame means, four hinge means mounted in rectangular configuration on said frame means, an elongated clamp jaw having an elongated clamping surface carried on each of said hinge means so as to provide two pairs of elongated clamp jaws with the jaws in each pair and said clamping surfaces thereon being swingable toward and away from each other and with the direction of swinging of each pair of clamp jaws being at 90° to the direction of swinging of the other pair, said clamp jaws forming a rectangular enclosure, and an axially extendable fluid-powered actuator operably interconnected between the clamp jaws of each pair thereof for forcibly swinging the clamp jaws and clamping surfaces of each pair toward each other, each of said fluid-powered actuators having a fluid connection through which fluid under pressure may be introduced to actuate the pair of clamp jaws operably interconnected by the actuator, and common fluid conduit means interconnecting said fluid-introducing connections on said actuators whereby the clamping forces exerted by said two pairs of clamp jaws are equalized.

2. The grapple clamp called for in claim 1 wherein said fluid-powered actuators are double-acting cylinders.

3. The grapple clamp called for in claim 2 wherein the corresponding fluid connections at opposite ends of said double-acting cylinders are interconnected so that the fluid pressures in said corresponding connections are equalized.

4. The grapple clamp called for in claim 1 wherein with said clamp positioned so that the axes of said hinge means extend in a generally horizontal direction said clamp jaws have object-engaging portions depending from said hinge means and on which said clamping surfaces are located and actuating portions projecting above said hinge means, each of said axially extendible fluid-powered actuators being operably interconnected between the actuating portions of one of said pairs of clamp jaws, and the moment or leverage arms of each clamp jaw being such that the clamp force exerted by each clamp jaw is the same.

5. The grapple clamp called for in claim 4 wherein said hinge means are piano hinges, said clamp jaws are flat plates, and said clamping surfaces are provided by resilient pads mounted on said object-engaging portions of said clamp jaws.

6. The grapple clamp called for in claim 1 wherein a pair of support beams project laterally from said frame means, a pair of parallel fork-receiving members are mounted in proper spaced relationship on said support beams, and at least one leveling screw is provided in the fork-receiving member that is outboard with respect to said frame means, each said leveling screw extending upwardly into said outboard fork-receiving member for engagement with the underside of the fork member therein.

* * * * *